US005344226A

United States Patent [19]

Lee

[11] Patent Number: 5,344,226

[45] Date of Patent: Sep. 6, 1994

[54] SAFETY DEVICE FOR DRAWERS

[76] Inventor: Wen-Ting Lee, No. 25, Lane 38, Yung Leh St., Lu Chou Hsiang, Taipei Hsien, Taiwan

[21] Appl. No.: 31,215

[22] Filed: Mar. 12, 1993

[51] Int. Cl.[5] ..... A47B 88/00

[52] U.S. Cl. ..... 312/334.47; 312/333; 292/163

[58] Field of Search ..... 292/163, 145, DIG. 65; 312/333, 334.46, 334.47

[56] References Cited

U.S. PATENT DOCUMENTS

| | | | |
|---|---|---|---|
| 441,308 | 11/1890 | Kenney | 312/334.47 |
| 1,704,964 | 3/1929 | Dilg | 312/334.47 |
| 2,699,568 | 1/1955 | Herscher | 312/334.47 |
| 3,799,638 | 3/1974 | Faiks | 312/333 |
| 3,854,785 | 12/1974 | Manner et al. | 312/333 |
| 4,168,103 | 9/1979 | Hagen | 312/333 |

FOREIGN PATENT DOCUMENTS

| | | | |
|---|---|---|---|
| 2532532 | 3/1984 | France | 312/333 |

*Primary Examiner*—Thomas E. Denion
*Attorney, Agent, or Firm*—William E. Pelton

[57] ABSTRACT

A safety device includes a substantially L-shaped mount securely mounted to an inner wall of a side panel of a drawer and a sliding assembly. The mount includes a vertical portion on which a first track is provided and a horizontal portion in which a hole is formed. The sliding assembly includes a body having at least one compartment for optionally receiving a stop and a second track extending longitudinally from the body. A member projects from the body and is slidably received in the first track. A pin extends downward from the body and has a snapping head at a distal end thereof to prevent excessive upward movement of the pin. A spring is wound around the pin. The sliding assembly further has a slider slidably received in the second track. By such an arrangement, the drawer is limited, by the upper edge of the desk, between the stop and the slider.

10 Claims, 6 Drawing Sheets

SAFETY DEVICE FOR DRAWERS

BACKGROUND OF THE INVENTION

The present invention relates to a safety device for drawers to prevent the hand of a user or child from being inadvertently injured as being "caught" by the drawer during operation.

Drawers are a common article in daily life. In use, a problem arises, namely the hand of a user or child is sometimes inadvertently caught and thus injured by the drawer due to carelessness.

Therefore, there has been a long and unfulfilled need for a safety device for drawers to obviate the aforementioned problem.

SUMMARY OF THE INVENTION

The safety device provided by the present invention generally includes a substantially L-shaped mount securely mounted to an inner wall of a side panel of a drawer and a sliding assembly. The mount includes a vertical portion on which a track means is provided and a horizontal portion in which a hole is formed. The track means includes a guiding slot extending vertically to slidably guide the sliding assembly.

The sliding assembly includes a body having at least one compartment for optionally receiving a stop and a second track means extending longitudinally from the body. The sliding assembly further has a member projecting from the body. A pin extends downward from the body and has a snapping head at a distal end thereof. A spring is wound around the pin.

The sliding assembly further has a slider slidably received in the second track means. The slider includes a base plate fittingly and slidably received in the second track means and a ridge projecting upward from the base plate. Two stop-pieces extend transversely from the rear of the base plate such that the base plate can only slide between the stop and the rear side of the track means where the stop-pieces are stopped. The stop is substantially as a triangular structure having a smooth operative surface which inclines from a rear end to a front end thereof where it abruptly declines like a cliff to define a stopping surface at the front end. The ridge has a smooth operative curvature which gradually declines from a rear end to a front end thereof.

The L-shaped mount 10 is securely fixed to the inner wall of the side panel or font panel of the drawer at its vertical portion thereof. The side member is slidably received in the track means of the mount and the pin is passed through hole and the snapping head is snapped under the horizontal portion to prevent an upward movement of the pin. After assembly, in order to perform the safety function, the stop is higher than the bottom of the upper edge of the desk when the spring is in its original position.

When the user opens the drawer, the upper edge firstly encounters the stop and again presses the whole sliding assembly downward during the outward movement of the drawer. The upper edge climbs over the stop and encounters the rear of the slider as the user further pulls the drawer outward. The body moves rearward (as the drawer is pulled rearward) and the slider remains there as it is stopped by the inner side of the upper edge. It is appreciated that at that time the downward force of the upper edge acting on the spring no longer exists. The sliding assembly moves upward due to spring force. The rearward movement of the drawer is stopped when the stop-pieces on the slider contact and are stopped by the rear of second track means. The upper edge of the desk is limited between the stops and the rear of the slider and the travel of the drawer is thus limited, thereby preventing the user's hand, especially the fingers, from being injured which is possibly caused if the user subsequently and inadvertently pushes the drawer inward. The safety device is particularly useful in preventing children from being injured when they open and close the drawer for fun.

The user may push the sliding assembly downward and then bend the pin toward him until a recess in the pin engages with the periphery of the hole, thereby retaining the sliding assembly in an inoperative position.

Other objects, advantages, and novel features of the invention will become more apparent from the following detailed description when taken in conjunction with the accompanying drawings.

DETAILED DESCRIPTION OF THE PREFERRED EMBODIMENT

In the following descriptions, the term "front" referred to represent a position which is distal to the user, and the term "rear" referred to represent a position which is adjacent to the user. Similarly, the term "forward" or "inward" referred to means away from the user, and the term "rearward" or "outward" referred to means toward the user.

Figure 1:
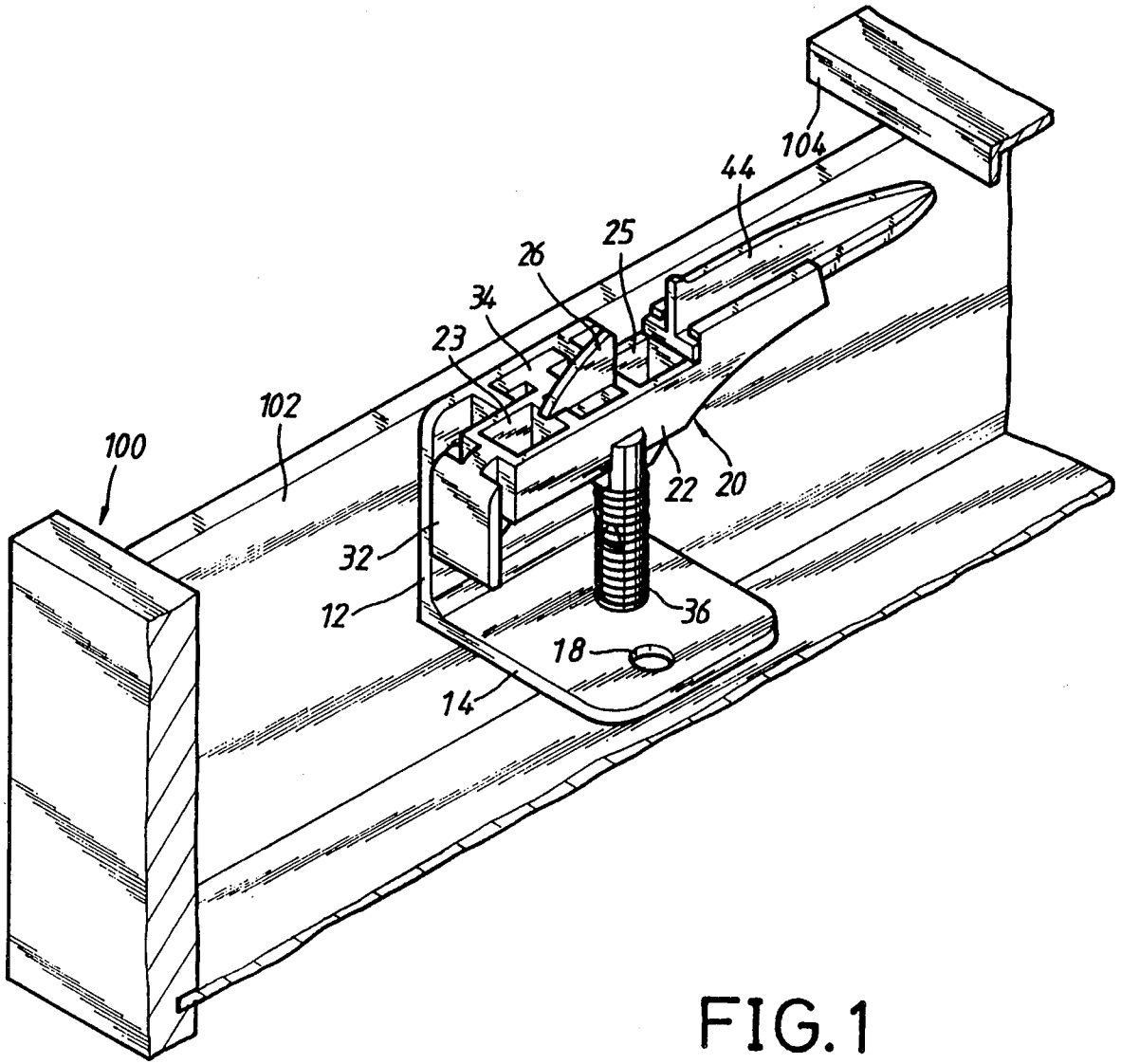
FIG. 1 is a perspective view of a safety device mounted in a drawer in accordance with the present invention.
Figure 2:
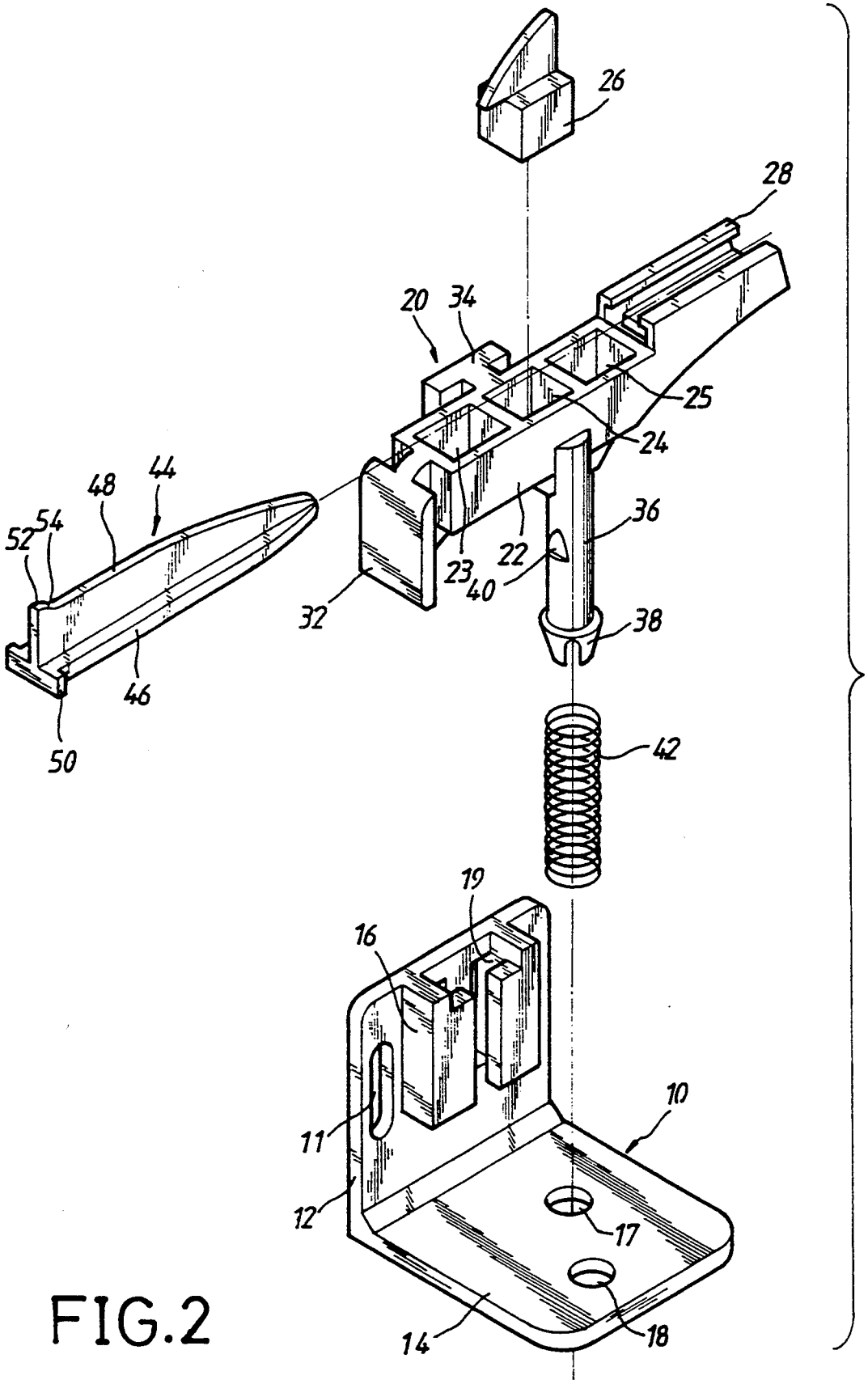
FIG. 2 is an exploded view of the safety device for drawers in accordance with the present invention.

Referring to the drawings and initially to FIGS. 1 and 2, a safety device for drawers in accordance with the present invention generally includes a substantially L-shaped mount 10 securely mounted to an inner wall of a side panel 102 of a drawer 100 and a sliding assembly 20. The mount 10 includes a vertical portion 12 on which a track means 16 is provided and a horizontal portion 14 in which two spaced holes 17 and 18 are formed. As shown in FIG. 2, the track means 16 includes a guiding slot 19 extending vertically to slidably guide the sliding assembly 20.

The sliding assembly 20 includes a body 22 having three compartments 23, 24, and 25 for optionally receiving a stop 26 and a second track means 28 extending longitudinally from the body 22. The sliding assembly 20 further has a rear member 32 and a side member 34 respectively provided to a rear side and a lateral side of the body. A pin 36 extends downward from the body 22 and has a snapping head 38 at a distal end thereof and a recess 40 in a middle of a periphery thereof. A spring 42 is wound around the pin 36 whose function will be described in detail later.

As shown in FIG. 2, the sliding assembly 20 further has a slider 44 slidably received in the second track means 28. The slider includes a base plate 46 fittingly and slidably received in the second track means 28 and a ridge 48 projecting upward from the base plate 46. Two stop-pieces 50 extend transversely from the rear of the base plate 46 such that said base plate 46 can only slide between the stop 26 and the rear side of the track means 26 where the stop-pieces 46 are stopped. It is, however, appreciated that only one stop-piece 46 can also achieve the same function. As can be seen from the drawings, the stop 26 is substantially as triangular structure having a smooth operative surface which inclines from a rear end to a front end thereof where it abruptly declines like a cliff to define a stopping surface at the front end. The ridge 48 has a smooth operative curvature which gradually declines from a rear end to a front end thereof. A sudden rise portion 54 is provided near the peak 52 and also has a smooth operative curvature to perform its function which will be discussed later.

Still referring to FIGS. 1 and 2, in mounting, the L-shaped mount 10 is securely fixed, such as by passing screws or other suitable fastening means through the elongated holes 11 (only one of them is shown) formed on both sides of the track means 16, to the inner wall of the side panel 102 of the drawer 100. The side member 34 is slidably received in the track means 16 of the mount 10 and the pin 36 is passed through hole 17 and the snapping head 38 is snapped under the horizontal portion 14 in a manner that an upward movement of the pin 36 is prohibited unless the snapping head 38 is pressed inward to release the pin 36. The slider 44 is slidably guided by the second track means 28 on the body 22 and the stop 26 is positioned in the middle compartment 24. After assembly, in order to perform the safety function, the stop 26 is higher than the bottom of the upper edge 104 of the desk when the spring 42 is in its original position (see FIG. 6).

Figure 9:
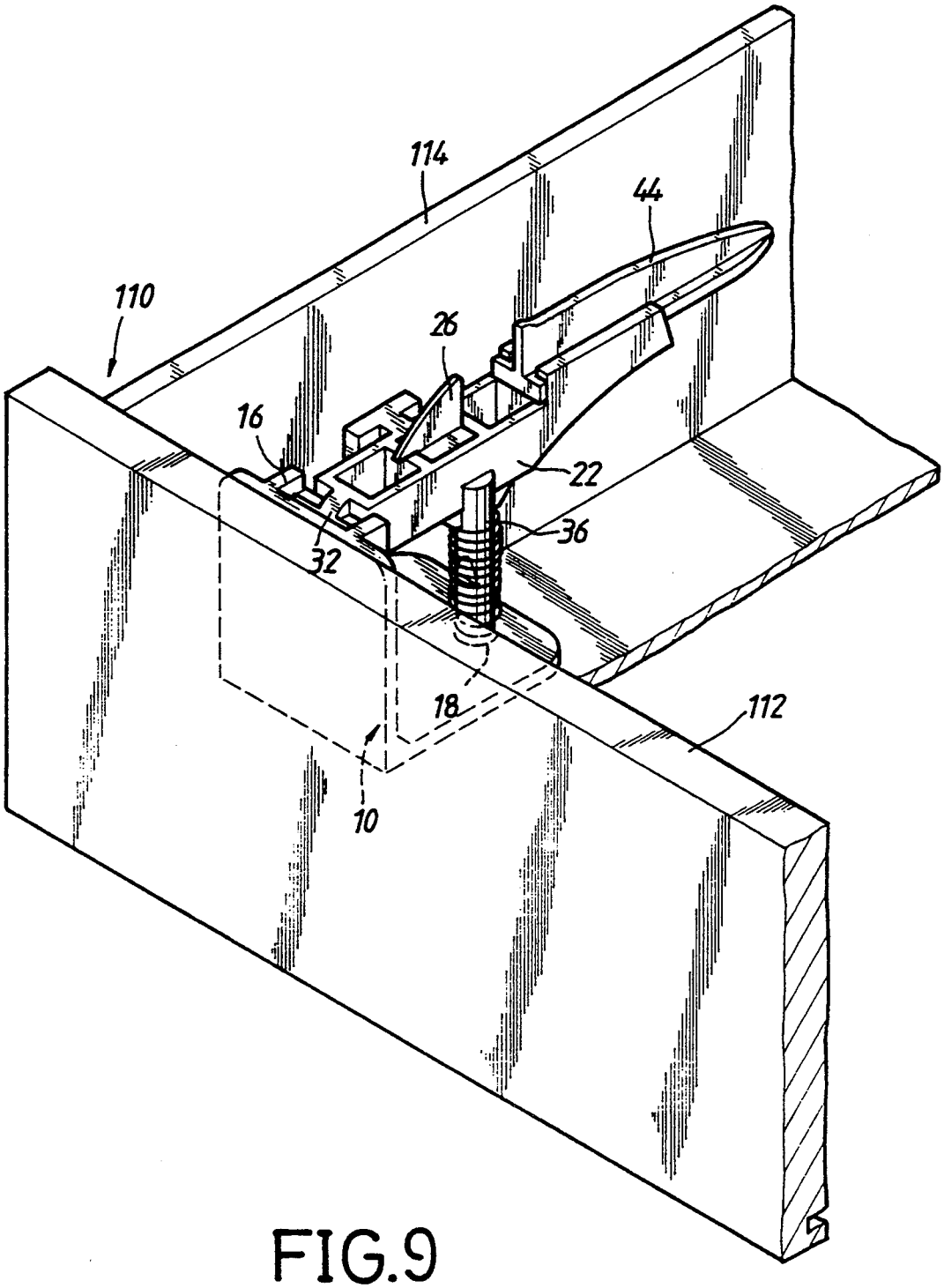
FIG. 9 is a view similar to FIG. 1, illustrating another embodiment for mounting the safety device in accordance with the present invention.

It is appreciated that the safety device 10 can be mounted to the inner wall of a front panel 112 of a bottom drawer 110 as shown in FIG. 9, especially in the case where the side panel 114 of the bottom drawer 110 is not sufficiently high for operation of the safety device 10 and the upper edge of a desk or the like which define the compartment for receiving the bottom drawer 110. In FIG. 9, it is the rear member 32 slidably received in the track means 16 on the mount 10 and the pin 36 passes through hole 18, not hole 17. It is, nevertheless, appreciated that operation of the safety device is identical to that shown in FIGS. 1 through 8 and thus will not be redundantly described.

Figure 3:
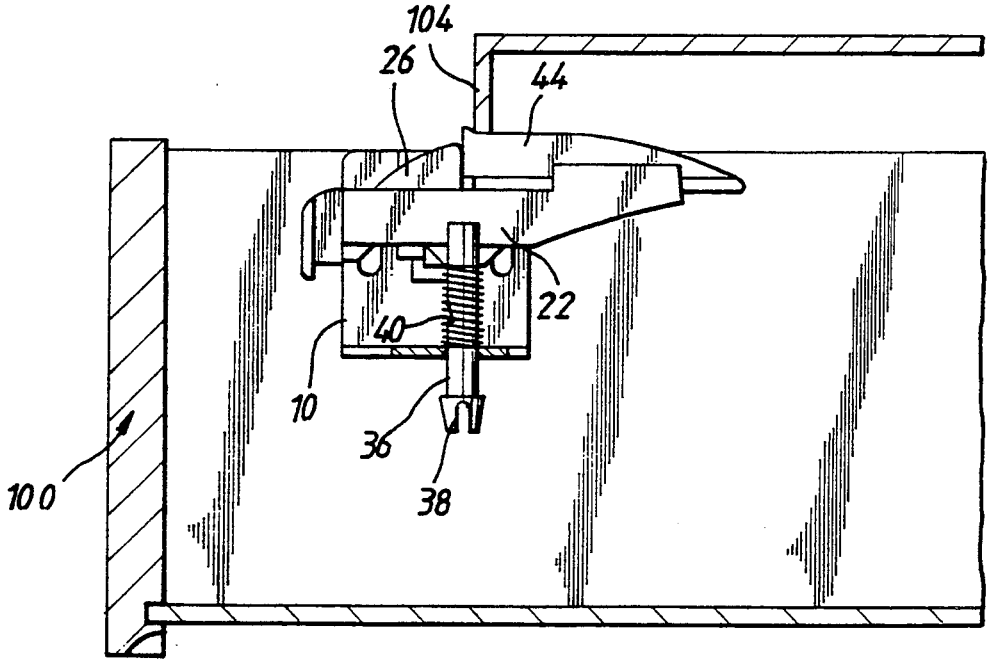
FIGS. 3 through 6 illustrates operation of the safety device wherein the drawer in FIG. 3 is being closed, the drawer in FIG. 4 is completely closed, the drawer in FIG. 5 is opened, and the drawer in FIG. 6 is limited between two positions by the safety device.
Figure 4:
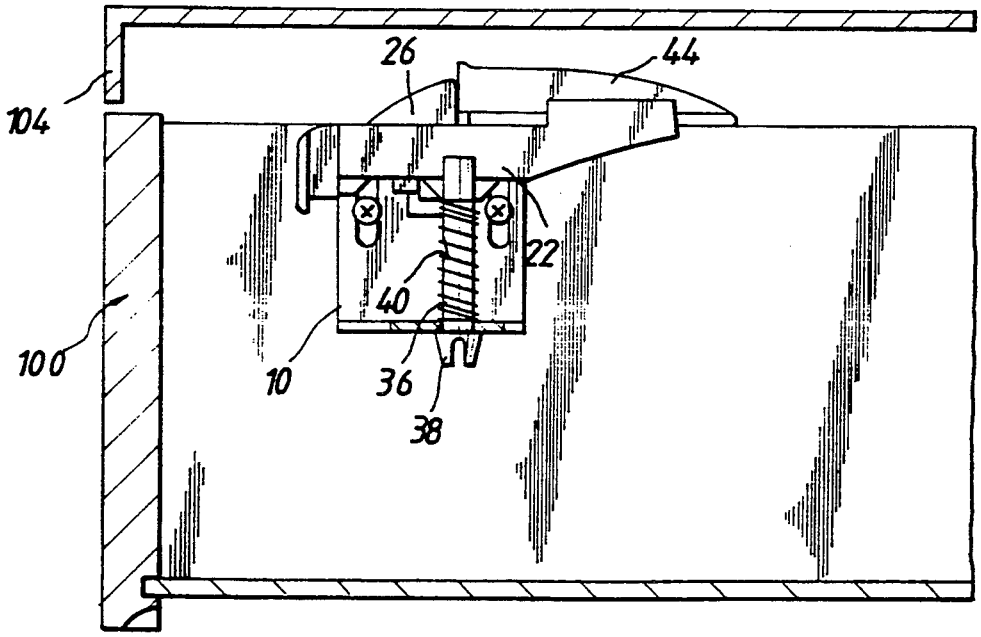

Operation of the safety device 10 is now described in the following paragraphs. Referring now to FIG. 3, it is appreciated that the drawer 100 is initially in an opened position, when the user closes the drawer 100 and thus push the drawer 100 inward, the upper edge 104 (which define the compartment for receiving the drawer 110) of the desk follows the operative curvature of the ridge 48 while presses the whole sliding assembly 20 downward (the spring 42 is compressed) until it encounters the sudden rising portion 54 of the ridge 48 of the slider 44 where the user can feel a stop and decide whether or not to further close drawer 100. If the user decides not to close the drawer 100, the drawer 100 is, of course, not further pushed inward. To the contrary, if the user decides to close the drawer 100 (for instance, the user does not work anymore and will leave the desk), the latter is further pushed inward (the upper edge 104 climbs over the peak 52) to a position shown in FIG. 4 in which the safety device is in an operative status (the spring returns to an original position which is slightly compressed).

Figure 5:
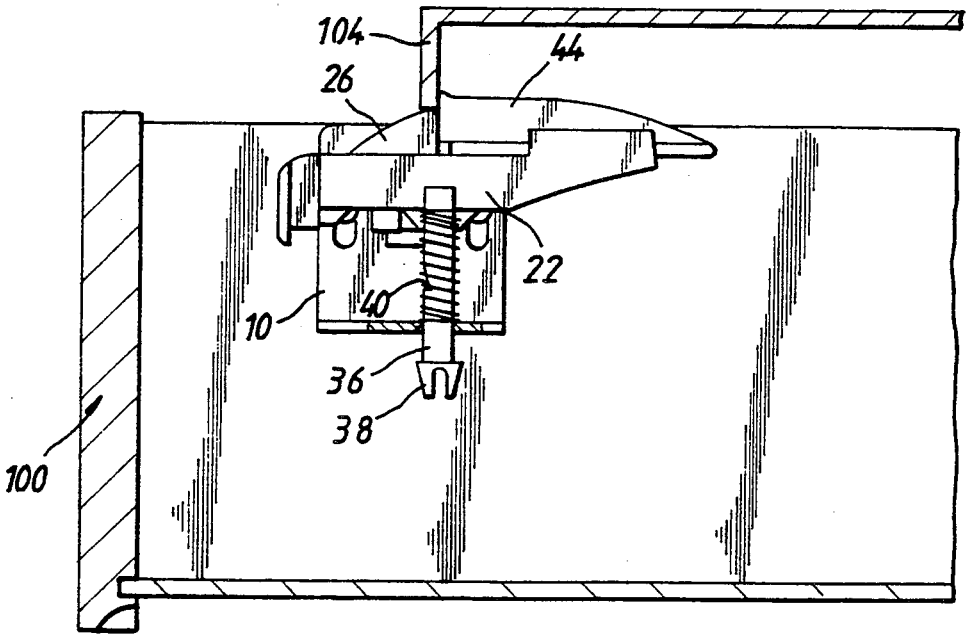
Figure 6:
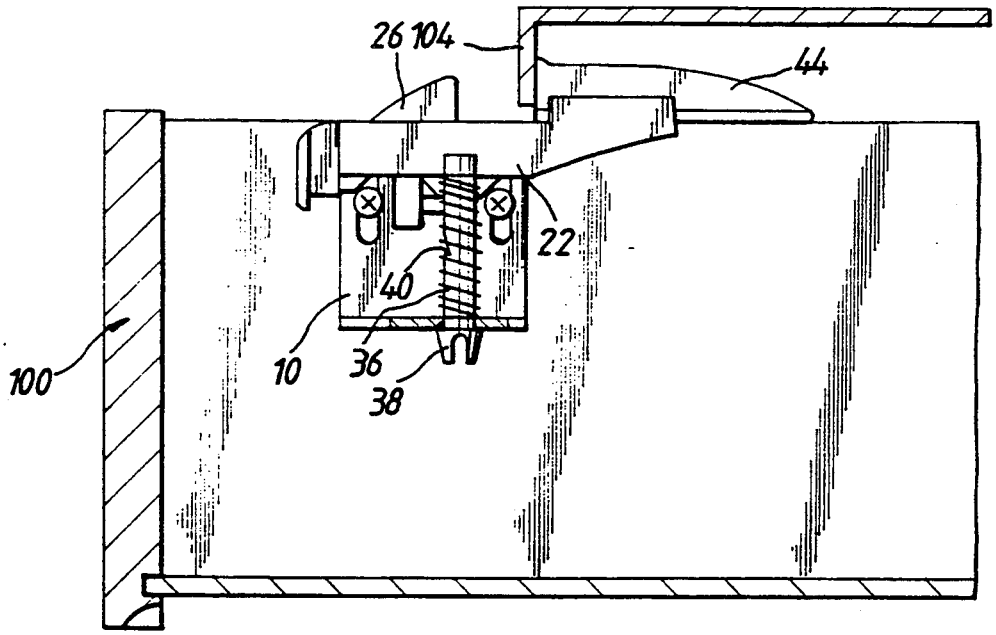
Figure 8:
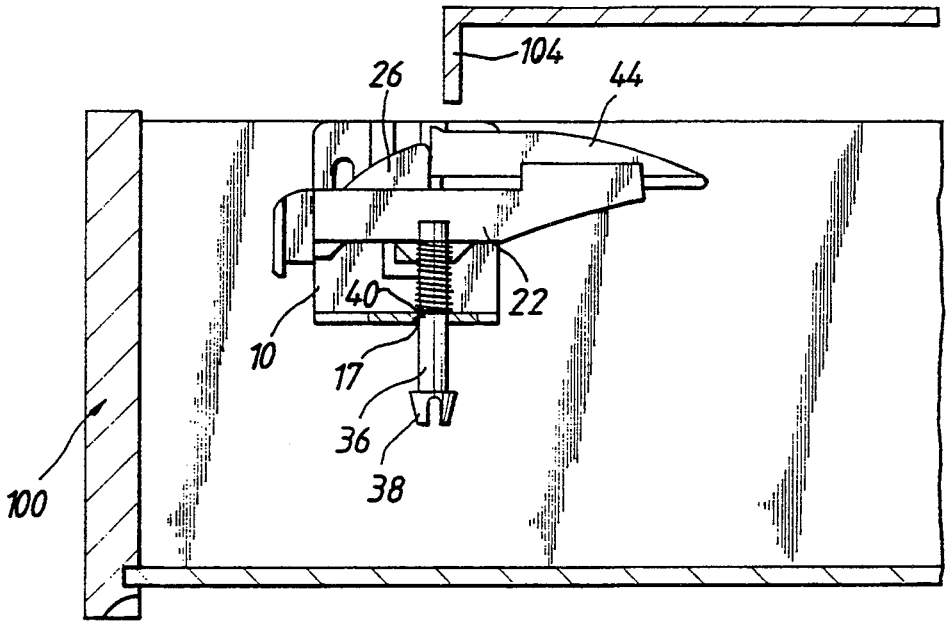
FIG. 8 is a schematic view in which the safety device is in an inoperative position.
Figure 7:
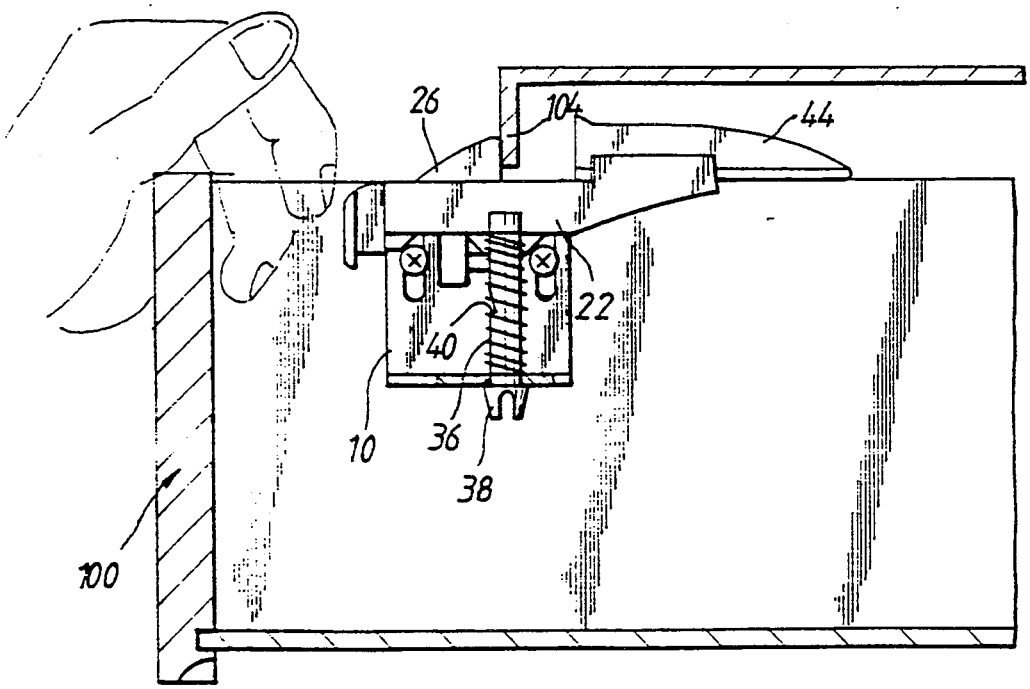
FIG. 7 is a view similar to FIG. 7 illustrating the protection of user's hand.

When the user reopens the drawer 100, the upper edge 104 firstly encounters the stop 26 and again presses the whole sliding assembly 20 downward during the outward movement of the drawer 100, as shown in FIG. 5. The upper edge 44 climbs over the stop 26 and encounters the rear of the slider 44 as the user further pulls the drawer outward. The body 22 moves rearward (as the drawer is pulled rearward) and the slider 44 remains there as it is stopped by the inner side of the upper edge 104. It is appreciated that the downward force of the upper edge 104 acting on the spring 42 not longer exists. The sliding assembly 20 moves upward due to spring force. The rearward movement of the drawer 100 is stopped when the stop-pieces 50 on the slider 44 contact and are stopped by the rear of second track means 28, as shown in FIG. 6. As clearly shown in FIG. 6, the upper edge 104 of the desk is limited between the stops 26 and the rear of the slider 44 and the travel of the drawer 100 is thus limited, thereby preventing the user's hand, especially the fingers (see FIG. 7), from being injured which is possibly caused if the user subsequently and inadvertently pushes the drawer inward. The safety device is particularly useful in preventing children from being injured (especially during the absence of adults) when they open and close the drawer 100 for fun.

If the user intends to use the drawer 100 for a considerable period of time and the drawer will be frequently closed and reopened, the user may push the sliding assembly 20 downward until the recess 40 lies on the same height as that of the hole 17 of horizontal portion 14 and then slightly pulls the pin 36 rearward such that the recess 40 engages with the periphery of the hole 17, thereby retaining the sliding assembly 20 in an inoperative position. Accordingly, the whole safety device is now in an inoperative status. As shown in FIGS. 3 through 6, the periphery of the hole is cut out to a thickness so as to engage with the recess 40 for retaining the sliding assembly in its inoperative status. Preferably, the pin 36 is made from flexible material so as to allow such bending. If the user wishes to reuse the safety device, he may push the pin 36 forward (inward) to release the engagement between the recess 40 and the periphery of the hole 17, the spring force will move the pin 36 upward to its operative position. When the sliding assembly 20 is in its operative status, the recess 40 is always above the hole 17 where it does not affect the operation of the pin 36.

Although the stop 26 in this preferred embodiment is received in the middle compartment 24, it is appreciated that it can be located in the first or last compartment 23 or 25, which accordingly varies the travel of the drawer 100 in FIG. 6.

Furthermore, if the user wishes to mount the safety device to the bottom drawer 110 of a desk shown in FIG. 9, he may use his fingers to press the snapping head 38 of the pin inward and then release his fingers. The spring force will allow the whole sliding assembly 20, including the pin 36 to "jump" upward such that the pin 36 disengages with the horizontal portion 14 of the mount 10. Thereafter, after removing the sliding assembly 20 from the mount 10, the user may remount the mount 10 to the inner wall of the front panel of the bottom drawer 110 and then the sliding assembly in a manner shown in FIG. 9. In the case where the upper edge structure 104 is not provided in the desk, an additional plate can be attached to the desk to substitute the upper edge.

The safety device in accordance with the present invention may have only one of side member 34 and rear member 32 provided on the body 22, and thus only one hole 18 or 17 is required in the horizontal portion 14 of the mount 10.

Although the invention has been explained in relation to its preferred embodiment, it is to be understood that many other possible modifications and variations can be made without departing from the spirit and scope of the invention as hereinafter claimed.

I claim:

1. A safety device for a drawer of a desk having a panel with an inner wall, said desk having an upper edge to define a compartment for receiving said drawer, said safety device comprising:

a mount securely mounted to said inner wall of said panel of said drawer, said mount comprising a vertical portion on which a first track is provided and a horizontal portion in which a hole is formed;

a sliding assembly comprising:

a body having at least one compartment, a stop being received in one of said one compartments, said stop having an upper operative curvature for guiding said upper edge during a closing movement of said drawer, said upper operative curvature inclining from an end thereof closer to a user to the other end thereof, a stopping surface being defined on said other end, a second track extending longitudinally from said body, a slider slidably received in said second track means, said slider having a second upper operative surface for guiding said upper edge during an opening movement of said drawer, a member projecting from said body and being vertically and slidably received in said first track, a pin extending downward from said body passing said hole and having a means at a distal end thereof to prevent said pin from disengagement with said hole, and a spring means being wound around the pin;

a top of said stop and said slider being high above a bottom of said upper edge of said desk when said spring means is in an original uncompressed status, whereby a motion of said drawer is restrained in two positions defined by said stopping surface of said stop and an end of said slider which is adjacent to the user.

2. The safety device as claimed in claim 1 wherein a sudden rising portion is formed on said second upper operative curvature of said slider adjacent to a peak thereof.

3. The safety device as claimed in claim 1 wherein said pin has a snapping head at said distal end thereof to allow a removable engagement between said pin and said hole on said mount.

4. The safety device as claimed in claim 1 wherein said pin is made of flexible material and has a recess formed in a periphery thereof, said sliding assembly being retained when said recess engages with a periphery of said hole.

5. The safety device as claimed in claim 1 wherein said slider comprises a base plate slidably received in said second track and a ridge projecting upward from the base plate, two stop-pieces extending transversely from a rear of said base plate, said upper operative curvature being formed on said ridge.

6. A safety device for a drawer of a desk having a panel with an inner wall, said desk having an upper edge to define a compartment for receiving said drawer, said safety device comprising:

a mount securely mounted to said inner wall of said panel of said drawer, said mount comprising a vertical portion on which a first track is provided and a horizontal portion in which two holes are formed;

a sliding assembly comprising:

a body having at least one compartment, a stop being received in one of said one compartments, said stop having an upper operative curvature for guiding said upper edge during a closing movement of said drawer, said upper operative curvature inclining from an end thereof closer to a user to the other end thereof, a stopping surface being defined on said other end, a second track extending longitudinally from said body, a slider slidably received in said second track, said slider having a second upper operative surface for guiding said upper edge during an opening movement of said drawer, a rear member and a side member projecting from said body on of which being vertically and slidably received in said first track, a pin extending downward from said body passing one of said holes and having a means at a distal end thereof to prevent said pin from disengagement with said hole, and a spring means being wound around the pin;

a top of said stop and said slider being high above a bottom of said upper edge of said desk when said spring means is in an original uncompressed status, whereby a motion of said drawer is restrained in two positions defined by said stopping surface of said stop and an end of said slider which is adjacent to a user.

7. The safety device as claimed in claim 6 wherein a sudden rising portion is formed on said second upper operative curvature of said slider adjacent to a peak thereof.

8. The safety device as claimed in claim 6 wherein said pin has a snapping head at said distal end thereof to allow a removable engagement between said pin and said hole on said mount.

9. The safety device as claimed in claim 6 wherein said pin is made of flexible material and has a recess formed in a periphery thereof, said sliding assembly being retained when said recess engages with a periphery of said hole.

10. The safety device as claimed in claim 6 wherein said slider comprises a base plate slidably received in said second track means and a ridge projecting upward from the base plate, two stop-pieces extending transversely from a rear of said base plate, said upper operative curvature being formed on said ridge.

* * * * *